US007100643B1

(12) United States Patent
Klima, Jr. et al.

(10) Patent No.: US 7,100,643 B1
(45) Date of Patent: Sep. 5, 2006

(54) CARTRIDGE FILLING AND SEALING APPARATUS

(75) Inventors: Walter F. Klima, Jr., Travelers Rest, SC (US); William L. Klima, Stafford, VA (US)

(73) Assignee: Sunpat L.L.C., Stafford, VA (US)

( * ) Notice: Subject to any disclaimer, the term of this patent is extended or adjusted under 35 U.S.C. 154(b) by 0 days.

(21) Appl. No.: 09/094,505

(22) Filed: Jun. 10, 1998

(51) Int. Cl.
*B65B 3/04* (2006.01)

(52) U.S. Cl. ..... 141/2; 141/9; 141/18; 141/100; 141/103; 141/104; 141/325

(58) Field of Classification Search ..... 141/2, 141/9, 100, 103, 104, 113, 18, 325; 222/94, 222/107, 129, 145.1; 53/474; 269/53, 54.5
See application file for complete search history.

(56) References Cited

U.S. PATENT DOCUMENTS 4,473,989 A * 10/1984 Tsutsumi et al. ..... 53/459
4,964,539 A * 10/1990 Mueller ..... 222/94
5,551,486 A * 9/1996 Hauser et al. ..... 141/1
5,775,386 A * 7/1998 Connan ..... 141/103

* cited by examiner

*Primary Examiner*—Timothy L. Maust
(74) *Attorney, Agent, or Firm*—William E. Klima

(57) ABSTRACT

An apparatus for filling a cartridge having at least two compartments for storing fluid includes at least one reservoir of fluid; at least two metering pumps connected to the at least one reservoir of fluid; and at least two filling tubes connected to the at least two metering pumps, respectively; wherein each filling tube simultaneously fills one of the at least two compartments in the cartridge with the fluid. The apparatus preferably includes a puck which defines a substantially cylindrical cavity and a pin eccentrically disposed in the substantially cylindrical cavity whereby the cartridge may be inserted in the cavity in the puck and aligned by insertion of the pin of the puck in an eccentric through hole of the cartridge. A rotary screw engages the puck and positions the cartridge for sealing.

27 Claims, 6 Drawing Sheets

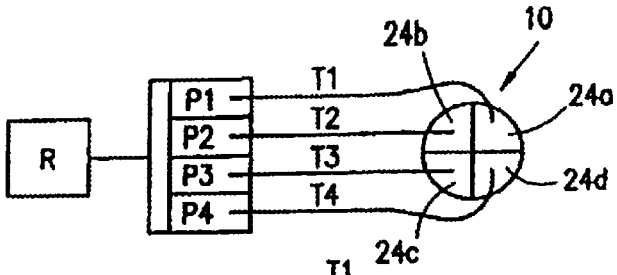
FIG. 5(c)
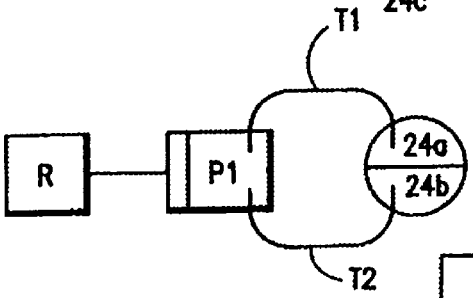
FIG. 5(e)
FIG. 5(d)
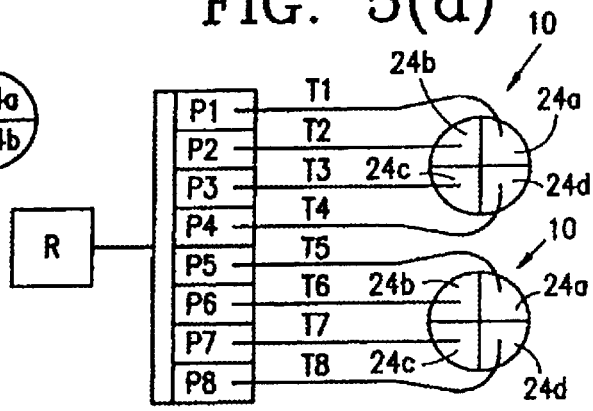
FIG. 6(a)
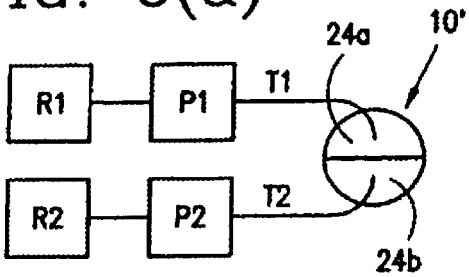
FIG. 6(c)
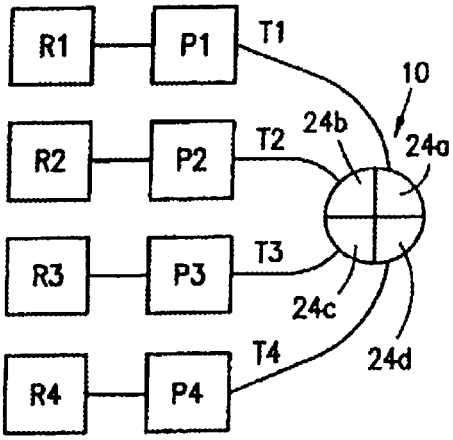
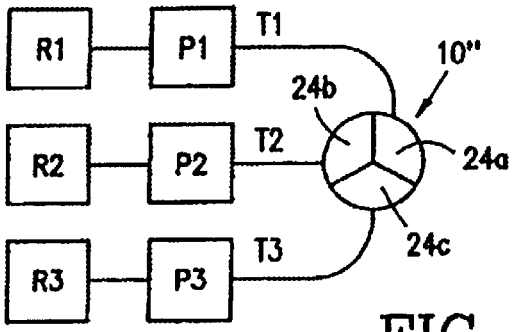
FIG. 6(b)

CARTRIDGE FILLING AND SEALING APPARATUS

BACKGROUND OF THE INVENTION

The present invention relates in general to automated machines for filling and sealing containers with fluids, and, in particular, to automated machines for filling and sealing cartridges (containers) having multiple compartments.

Automated machines that dispense fluid into containers having only one compartment are known (e.g. machines for filling beverage cans or bottles). Because there is only one compartment per container, the container need not be in any specific alignment with the filling mechanism. Also, the container can store only one type of fluid because there is only one storage compartment in the container.

When filling containers having multiple compartments, it is necessary that the container and the filling mechanism be aligned in a particular way such that each compartment is filled. In addition, when dispensing different fluids in the multiple compartments, it is necessary that the container be correctly aligned so that the differing fluids enter the proper compartments.

It is also advantageous that the filling nozzles be inserted into the compartments during filling. If the nozzles are not inserted, it is possible that the fluid will splash during filling or that some fluid flow will be misdirected. At a minimum, splashing and misdirected flow result in product loss, soiled container exteriors and soiling of the machinery and work space. When the fluid is hazardous or corrosive, the results of splashing and misdirected flow can be much more severe. Additionally, when different fluids are dispensed in the compartments, it is important to prevent one fluid from contaminating another fluid.

Some fluid containers having a single compartment are sealed with, for example, a foil using a heating head. In the single compartment containers, only the circumference of the container is sealed. Sealers for single compartment containers generally use a convex heating head. Because of the construction of multiple compartment containers, additional surfaces (i.e., the tops of the surfaces that divide the container into multiple compartments) other than the circumference must be sealed. Thus, convex heating heads are undesirable because the surfaces interior to the circumference must be melted down before the circumferential surface is sealed.

SUMMARY OF THE INVENTION

It is an object of the present invention to provide an apparatus and method for filling cartridges having multiple compartments.

It is another object of the present invention to provide an apparatus and method for filling cartridges having multiple compartments wherein differing fluids may be dispensed in the multiple compartments.

It is a further object of the present invention to provide an apparatus and method for aligning cartridges with the filling mechanism.

It is yet another object of the present invention to provide an apparatus and method for filling cartridges having multiple compartments wherein the filling nozzles may be inserted into the compartments during the filling operation.

It is still a further object of the present invention to provide an apparatus and method for saleing cartridges having multiple compartments.

These and other objects of the invention are achieved by an apparatus for filling a cartridge having at least two compartments for storing fluid, comprising at least one reservoir of fluid; at least two metering pumps connected to the at least one reservoir of fluid; and at least two filling tubes connected to the at least two metering pumps, respectively; wherein each filling tube simultaneously fills one of the at least two compartments in the cartridge with the fluid.

Preferably, the cartridge is substantially cylindrical and defines an eccentric through hole therein, the apparatus further comprising a puck which defines a substantially cylindrical cavity and a pin eccentrically disposed in the substantially cylindrical cavity whereby the cartridge may be inserted in the cavity in the puck and aligned by insertion of the pin of the puck in the eccentric through hole of the cartridge.

Most preferably, the apparatus further comprises a plate; at least two nozzles connected to the at least two filling tubes, respectively; the at least two nozzles being mounted in the plate; and a reciprocating carrier connected to the plate such that the at least two nozzles can be inserted into and removed from the at least two compartments of the cartridge.

Another aspect of the invention is an apparatus for filling a cartridge having first, second, third and fourth compartments for storing fluid, comprising first, second, third and fourth reservoirs containing first, second, third and fourth fluids, respectively; first, second, third and fourth metering pumps connected to the first, second, third and fourth reservoirs, respectively; first, second, third and fourth filling tubes connected to the first, second, third and fourth metering pumps, respectively; wherein the first, second, third and fourth filling tubes simultaneously fill the first, second, third and fourth compartments in the cartridge with the first, second, third and fourth fluids, respectively.

Preferably, this aspect of the apparatus further comprises a plate; first, second, third and fourth nozzles connected to the first, second, third and fourth filling tubes, respectively; the first, second, third and fourth nozzles being mounted in the plate; and a reciprocating carrier connected to the plate such that the first, second, third and fourth nozzles can be inserted into and removed from the first, second, third and fourth compartments of the cartridge.

A further aspect of the invention is a method of filling a cartridge having at least two compartments for storing fluid, comprising placing the cartridge under at least two nozzles; inserting the at least two nozzles into the at least two compartments of the cartridge such that only one nozzle enters each compartment; filling the at least two compartments with fluid; and removing the at least two nozzles from the at least two compartments.

In a preferred embodiment, the method further comprises, before the placing step, the step of loading the cartridge in a puck and aligning the cartridge by inserting a pin of the puck in an eccentric through hole in the cartridge.

Still a further aspect of the invention is an apparatus for sealing a cartridge having at least two compartments wherein the cartridge is substantially cylindrical and defines an eccentric through hole therein, comprising a puck which includes a substantially cylindrical cavity and a pin eccentrically disposed in the substantially cylindrical cavity, whereby the cartridge may be inserted in the cavity in the puck and aligned by insertion of the pin in the eccentric through hole; a screw which engages the puck and thereby positions the cartridge for sealing; and a sealer for sealing the cartridge.

Preferably, the sealer has a flat heating head.

Another aspect of the invention is a method of sealing a cartridge having at least two compartments wherein the cartridge is substantially cylindrical and defines an eccentric through hole therein, comprising loading the cartridge in a puck and aligning the cartridge by inserting a pin of the puck in the eccentric through hole in the cartridge; engaging the puck with a screw to position the cartridge for sealing; and sealing the cartridge.

Further objects, features and advantages of the present invention will become apparent from the following detailed description taken in conjunction with the following drawing.

BRIEF DESCRIPTION OF THE DRAWING

FIGS. 5*a*–5*e* schematically show various arrangements of an apparatus for filling one or more cartridges having multiple compartments.

FIGS. 6*a*–6*d* schematically show various embodiments of an apparatus for filling cartridges having multiple compartments with two or more different fluids.

DETAILED DESCRIPTION OF THE PREFERRED EMBODIMENTS

Figure 1:
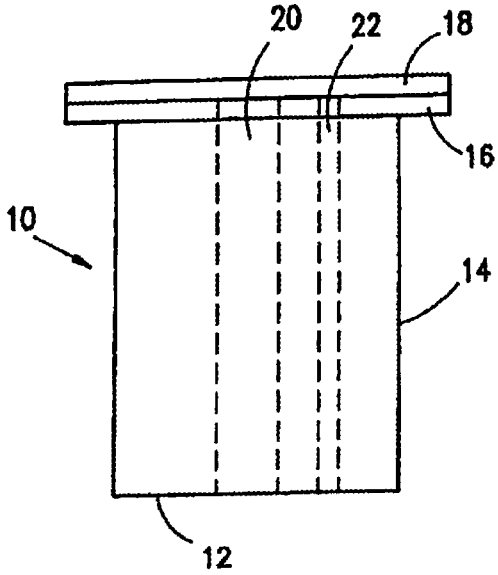
FIG. 1 is an elevation view of an example of a cartridge which may be filled and sealed using the apparatus and method of the invention.
Figure 2:
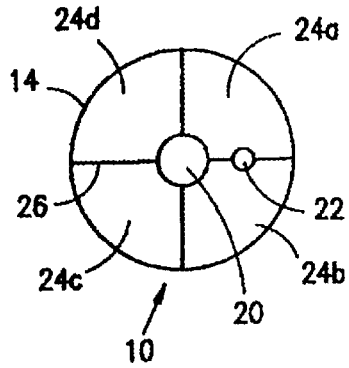
FIG. 2 is a top view of the cartridge of FIG. 1.

The present invention is an apparatus and method for filling and sealing cartridges (containers) such as the cartridges 10, 10' and 10" shown in FIGS. 1–4. The cartridge 10 includes a generally cylindrical body 14, a bottom wall 12, a flange 16, and a seal 18. The cartridge 10 is provided with four (4) compartments 24*a*, 24*b*, 24*c*, 24*d* for storing, for example, fluids. The compartments 24*a*, 24*b*, 24*c*, 24*d* are defined by the ribs 26. The cartridge 10 is provided with a through hole 20 to accommodate the down tube of a spray head and a second eccentric through hole 22 for accommodating and storing a probe or bayonet.

The cartridge 20 is preferably made by injection molding a plastic material (e.g., polyethylene, high density polyethylene, polypropylene, polyvinyl chloride, PETE, etc.).

The upper ends of the compartments 24*a*, 24*b*, 24*c*, 24*d* are sealed by a seal 18, as shown in FIG. 1. The seal 18 may be in the form of a membrane, for example, a metal foil, polymer film, composite polymer film, composite film of foils and/or films, or other suitable sealing membranes. The seal 18 may be applied by adhesive, thermal welding, inductive welding, ultrasonic welding, or other suitable methods. In addition to the seal 18, it has been found that the use of a cap type seal (not shown) is particularly suitable utilizing thermal and/or inductive heating or welding to ensure a long lasting airtight seal.

Figure 3:
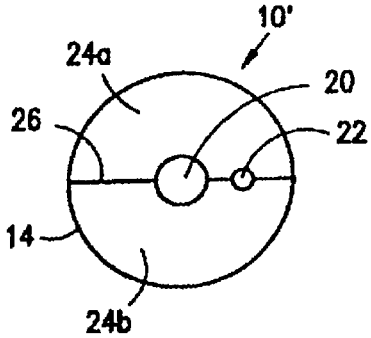
FIG. 3 is a top view of another embodiment of a cartridge for use with the present invention.
Figure 4:
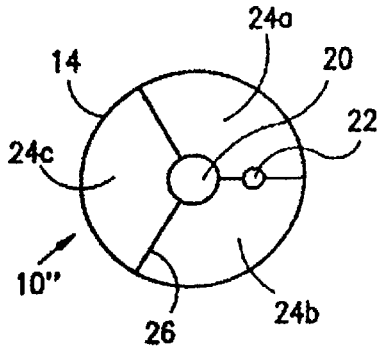
FIG. 4 is a top view of a further embodiment of a cartridge for use with the present invention.

Of course, a multiple compartment cartridge may have other than four compartments. FIGS. 3 and 4 are top views of two-compartment and three-compartment cartridges 10' and 10", respectively. Pending patent application Ser. No. 09/082,469, filed May 21, 1998, entitled "Probe for Rechargeable Dispensers" and having the same inventors as the present application discloses one particular field of applications for the cartridges (also referred to as "inserts") which are filled and sealed in accordance with the present invention. The above-referenced patent application is herein fully incorporated by reference.

Figure 5A:
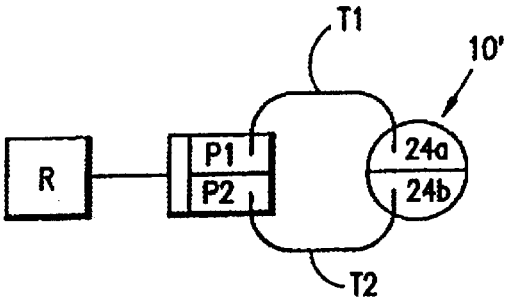
Figure 5B:
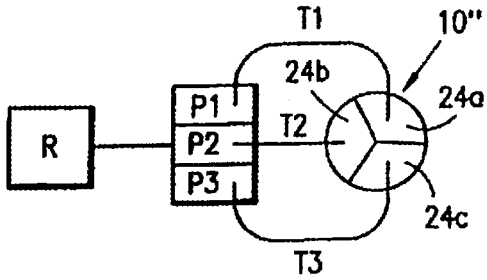

FIGS. 5(*a*)–5(*e*) schematically show an apparatus for filling multiple compartment cartridges in accordance with the present invention. In FIG. 5(*a*), a reservoir R provides a supply of the fluid used to fill the cartridges. Two metering pumps P1, P2 are connected to the reservoir R. Two filling tubes T1, T2 are connected to the two metering pumps P1, P2, respectively. Each filling tube T1, T2 simultaneously fills one of the two-compartments 24*a*, 24*b* in the compartment cartridge 10' with the fluid.

FIG. 5(*b*) shows an embodiment of the invention for filling a three-compartment cartridge 10". The reservoir R is connected to three metering pumps P1, P2, P3. Three filling tubes T1, T2, T3 are connected to the three metering pumps P1, P2, P3, respectively. Each filling tube T1, T2, T3 simultaneously fills one of the three compartments 24*a*, 24*b*, 24*c* in the cartridge 10" with the fluid.

FIG. 5(*c*) shows an embodiment of the invention for filling a four-compartment cartridge 10. The reservoir R is connected to four metering pumps P1, P2, P3, P4. Four filling tubes T1, T2, T3, T4 are connected to the four metering pumps P1, P2, P3, P4, respectively. Each filling tube T1, T2, T3, T4 simultaneously fills one of the four compartments 24*a*, 24*b*, 24*c*, 24*d* in the cartridge 10 with the fluid.

FIG. 5(*d*) shows an embodiment of the invention for simultaneously filling two four-compartment cartridges 10. The reservoir R is connected to eight metering pumps P1, P2, P3, P4, P5, P6, P7, P8. Eight filling tubes T1, T2, T3, T4, T5, T6, T7, T8 are connected to the eight metering pumps P1, P2, P3, P4, P5, P6, P7, P8, respectively. Each filling tube T1, T2, T3, T4, T5, T6, T7, T8 simultaneously fills one of the four compartments 24*a*, 24*b*, 24*c*, 24*d* in each of the two cartridges 10 with the fluid.

FIG. 5(*e*) shows an embodiment of the invention for simultaneously filling two-compartments 24*a* and 24*b* from a single pump P1 supplied by reservoir R.

It should be understood that additional metering pumps and filling tubes may be used to simultaneously fill additional multiple compartment cartridges. The metering pumps may be, for example, positive displacement piston-type pumps.

If multiple reservoirs of fluid are used, then different fluids can be dispensed in the different compartments of a cartridge. FIGS. 6*a*–6*d* schematically show various embodiments of the inventive filling apparatus having more tha n one reservoir. For example, in FIG. 6*a*, two reservoirs R1 and R2 cntain first and second fluids which may be the same or different fluids. Reservoirs R1 and 2 supply fluid to the metering pumps P1 and P2, respectively. Filling tubes T1 and T2 are connected to the metering pumps P1, P2, respectively. Filling tubes T1, T2 simultaneously fill the two compartments 24*a*, 24*b* of the cartridge 10'.

FIG. 6*b* shows an embodiment having three reservoirs R1, R2, R3. The three reservoirs R1, R2, R3 may each contain the same fluid, may each contain a different fluid or two reservoirs may contain the same fluid while the third reservoir contains a different fluid. The three reservoirs R1, R2, R3 are connected to three metering pumps P1, P2, P3, respectively. The three metering pumps P1, P2, P3 are connected to three filling tubes T1, T2, T3. The three filling tubes T1, T2, T3 simultaneously fill the first, second and third compartments 24*a*, 24*b*, 24*c*, respectively of the cartridge 10" with fluid.

FIG. 6*c* shows an embodiment wherein four reservoirs R1–R4 are connected to four metering pumps P1–P4, respectively. The four metering pumps P1–P4 arc connected to four filling tubes T1–T4, respectively. The fluid in each reservoir R1–R4 may be the same, or the fluid in each of the four reservoirs may be different, that is, there are four different fluids. Or, the fluids in R1 and R2 may be the same, and the fluids in R3 and R4 may be the same, but different from the fluid in R1 and R2. Also, three of the reservoirs may have the same fluid while the fourth reservoir has a different fluid. The four filling tubes T1–T4 simultaneously fill the four compartments 24*a–d* in the cartridge 10 with fluid.

Figure 6D:
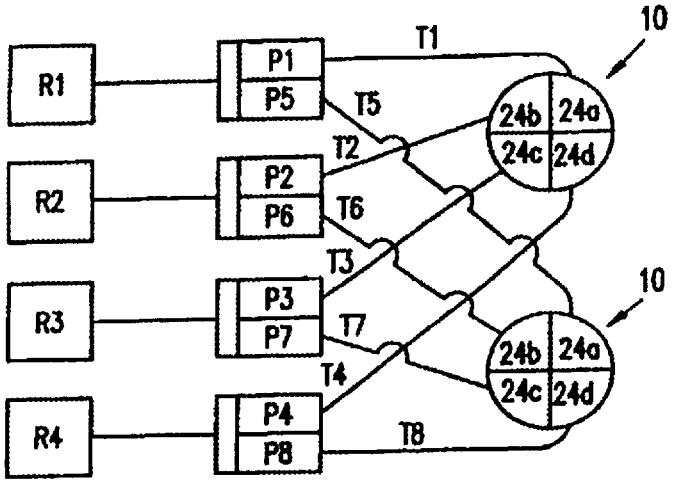

FIG. 6*d* shows an embodiment of the filling apparatus having four reservoirs R1–R4 which may contain any combination of the same or different fluids. In the apparatus shown in FIG. 6*d*, two four-compartment cartridges 10 are filled. The reservoirs R1–R4 are connected to pumps P1, P5; P2, P6; P3, P7; and P4, P8, respectively. Filling tubes T1–T8 are connected to each of the metering pumps P1–P8, respectively. Pumps P1–P4 are connected to compartments 24*a–d* in the first cartridge 10 and pumps P5–P8 are connected to compartments 24*a–d* in the second cartridge 10. Therefore, two four-compartment cartridges 10 may be filled simultaneously with different combinations of fluid. Of course, the combination of fluids in one cartridge will be the same as the combination of fluids in the second cartridge.

It should be understood that additional reservoirs with additional metering pumps and filling tubes may be used to simultaneously fill additional multiple compartment cartridges.

Figure 7:
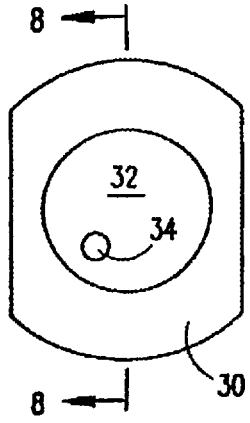
FIG. 7 is a plan view of a puck.
Figure 8A:
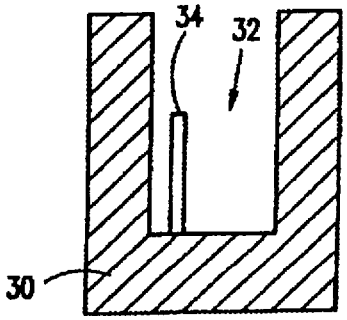
FIG. 8*a* is a sectional view of a puck taken along the line 8—8 of FIG. 7.
Figure 8B:
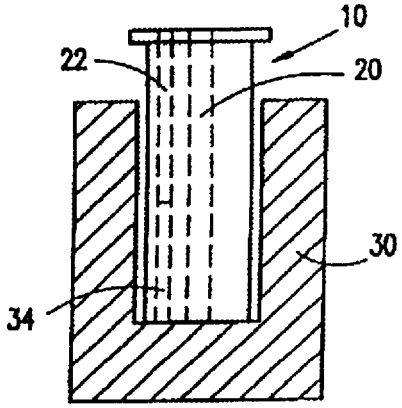
FIG. 8*b* is the sectional view of FIG. 8*a* including a cartridge that is not shown in section.

FIGS. 7 and 8*a–b* show a puck 30 for use in the invention. FIG. 7 is a top view of a puck. FIG. 8*a* is a sectional view of the puck of FIG. 7 taken along the line 8—8 of FIG. 7. FIG. 8*b* shows a cartridge 8*b* shows a cartridge 10 (not in section) in the view of FIG. 8*a*.

In general, pucks are known devices for conveying containers to be filled. However, in the present invention, the puck 30 includes a substantially cylindrical cavity 32 and a pin 34 which is eccentrically located in the cavity 32. When a cartridge such as cartridge 10, 10', 10" is loaded into the puck 30, the cartridge must be aligned so that the pin 34 penetrates the eccentric through hole 22 of the cartridge. Alignment of the cartridge in the puck 30 in this manner prevents the cartridge from rotating in the puck 30 and thereby assures proper alignment of the multiple compartments in the cartridge with the filling nozzles.

Figure 9:
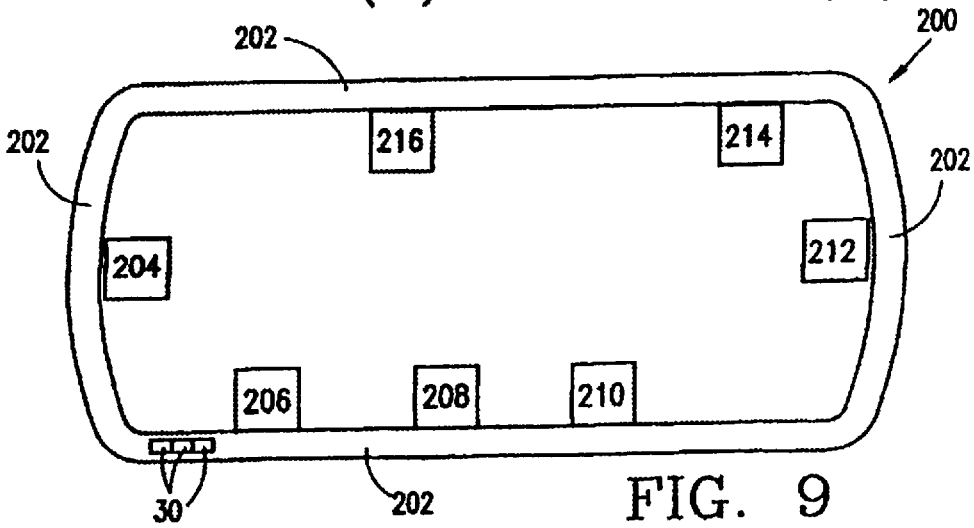
FIG. 9 is a schematic view of an assembly line used to fill, seal, cap and code multiple compartment cartridges.

FIG. 9 schematically shows an assembly line 200 for filling multiple compartment cartridges. The components of the assembly line are connected by a conveyor 202. At the puck inserter 204, cartridges are inserted and aligned in pucks 30 which are carried along the conveyor 202. At the filler 206, fluid is added to the compartments of the cartridges. At the sealer 208, a sealing foil or film is applied to the top of the cartridge. At the coder 210, the sealing foil or film is stamped or printed to identify the different compartments. For example, in a four-compartment cartridge, the seal may be stamped with the numerals 1, 2, 3 and 4 over the respective compartments. At the foil punch 212, the foil seal is punched to open the center through hole 20 and the eccentric through hole 22. At the capper 212, the cartridge is further sealed with a snap-type cap. At the puck unloader 216, the cartridges are unloaded from the pucks 30 and the pucks 30 proceed to the puck inserter 204 to pick up a new unfilled cartridge. The present invention is prinlarily directed to the filler 206 and sealer 208.

Figure 10:
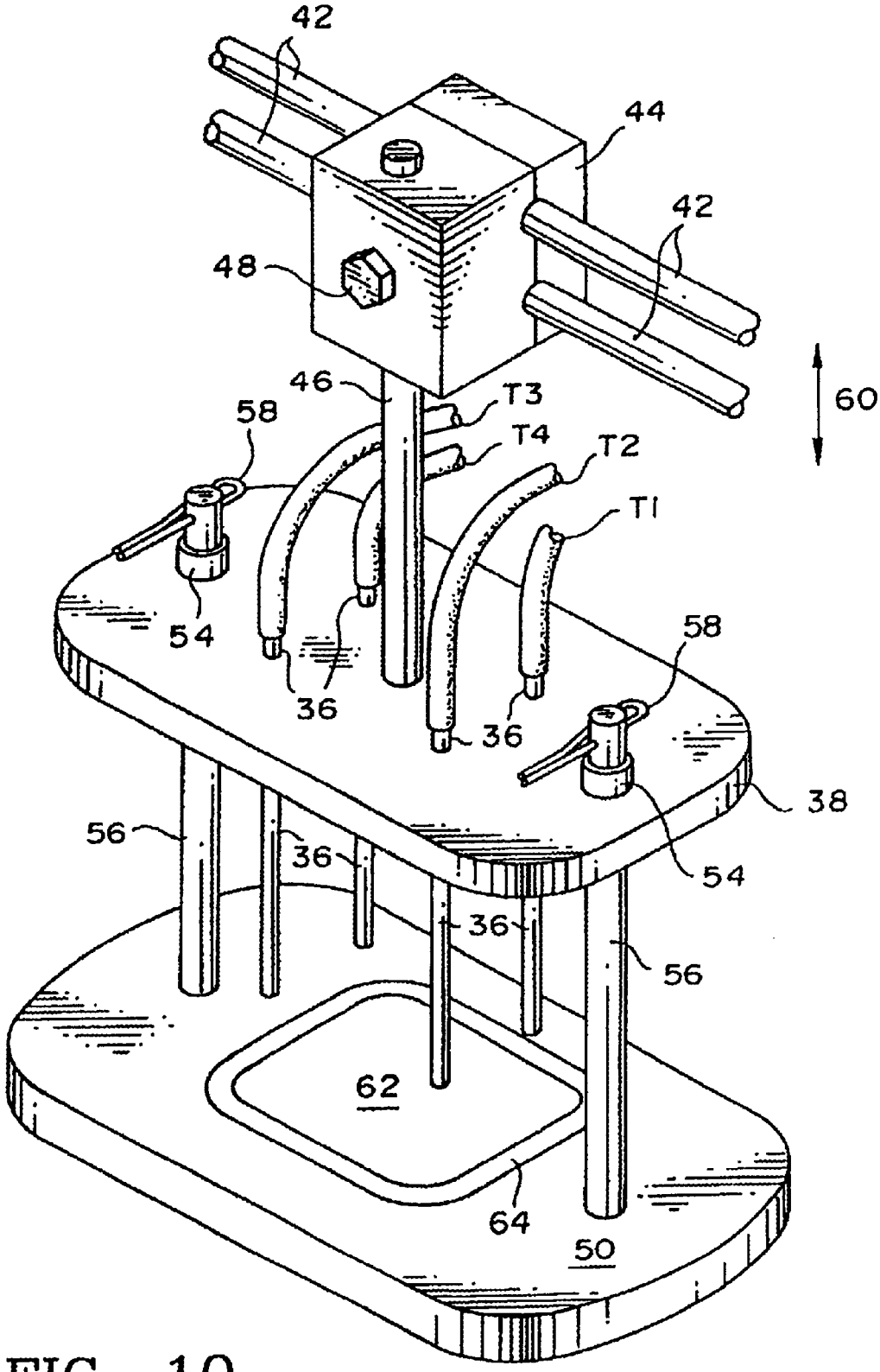
FIG. 10 is a perspective view showing the nozzle arrangement of the present invention.

FIG. 10 is a perspective view ofthe arrangement of the filling tubes and nozzles with respect to a reciprocating carrier 40. The filling tubes T1, T2, T3 and T4 are each connected to a nozzle 36. In FIG. 10, the filling tubes are only partially shown. The nozzles 36 are mounted in holes in a top plate 38 which is connected by a rod 46 to a locking block 44. The locking block 44 is secured to the slide rods 42 of the reciprocating carrier 40 by a lock screw 48. In FIG. 10, only the slide rods 42 of the reciprocating carrier 40 are shown. The reciprocating carrier 40 is shown in more detail in FIG. 11. When the lock screw 48 is loosened, the locking block 44 may be moved along the slide rods 42 so that the nozzles 36 are properly positioned for filling the multiple compartments of a cartridge. One or more locking blocks 44 with rods 46, top plates 38 and nozzles 36 may be mounted on the slide rods 42. Thus, it may be seen that several multiple compartment cartridges may be filled simultaneously.

The slide rods 42 of the reciprocating carrier 40 reciprocate up and down, that is, in the direction shown by the arrow 60 in FIG. 10. Rods 56 passing through bushings 54 in top plate 38 establish a movable connection between bottom plate 50 and top plate 38. Cotter pins 58 prevent the rods 56 from falling out of bushings 54. Bottom plate 50 defines a center opening 62 and includes an insert plate 64 fitted around the periphery of the opening 62. The insert plate 64 is preferably made of plastic and is inserted in plate 50 with a slight interference fit.

In operation, a puck 30 containing a multiple compartment cartridge moves along the conveyor 202 of the assembly line 200 of FIG. 9 and stops under the nozzles 36. The slide rods 42 ofthe reciprocating carrier 40 then move downward such that the insert plate 64 contacts the cartridge. After the insert plate 64 contacts the cartridge, the nozzles 36 are further lowered into the multiple compartments. Because the bottom plate 50 is movably connected to the top plate 38, the bottom plate 50 is essentially stationary as the top plate 38 is further lowered. When the nozzles 36 are inserted in the multiple compartments of the cartridge, the downward motion is stopped. The multiple compartments are then filled with fluid flowing from one or more reservoirs through metering pumps and fill tubes to the nozzles 36. After the multiple compartments have been filled with fluid, the slide rods 42 begin to move vertically upward and the nozzles 36 are removed from the multiple compartments of the cartridge. The process is then repeated for another cartridge. Of course, with multiple sets of top plates 38 and nozzles 36, more than one cartridge may be filled simultaneously. The pucks 30 loaded with cartridges are properly aligned in the direction of the conveyor 202 under the nozzles 36 by an indexing star (not shown). Such an indexing star is known in the art because even single compartment containers must be aligned in the direction of the conveyor 202.

The bottom plate 50 and insert plate 64 serve a safety function. For example, as the top plate 38 and the bottom plate 50 are lowered, the insert plate 64 first contacts the cartridge to be filled. As the top plate 38 with attached nozzles 36 is further lowered, the rods 56 move upward through the bushings 54. Should any jamming of the rods 56 occur, that is, if the upward movement of the rods 56 is somehow restricted, then the insert plate 64 resting on the cartridge will break away from the bottom plate 50 and allow the bottom plate 50 to move freely downward by force of gravity. The bottom plate 50 can move downward because it is not resting on the cartridge, only the insert plate 64 rests on the cartridge. Thus, the removable insert plate 64 prevents damage to the filling mechanism due to jamming of the top plate 38 during its downward movement. The total range of motion for the top plate 38 is about 1 to 1.5 inches.

Insertion of the nozzles 36 in the cartridge during filling has several advantages. First, spill and splash of the fluid is minimized. Second, where different fluids are being filled in different compartments, inserting the nozzles into the respective compartments minimizes the possibility of one fluid being mixed with a different fluid.

Figure 11:
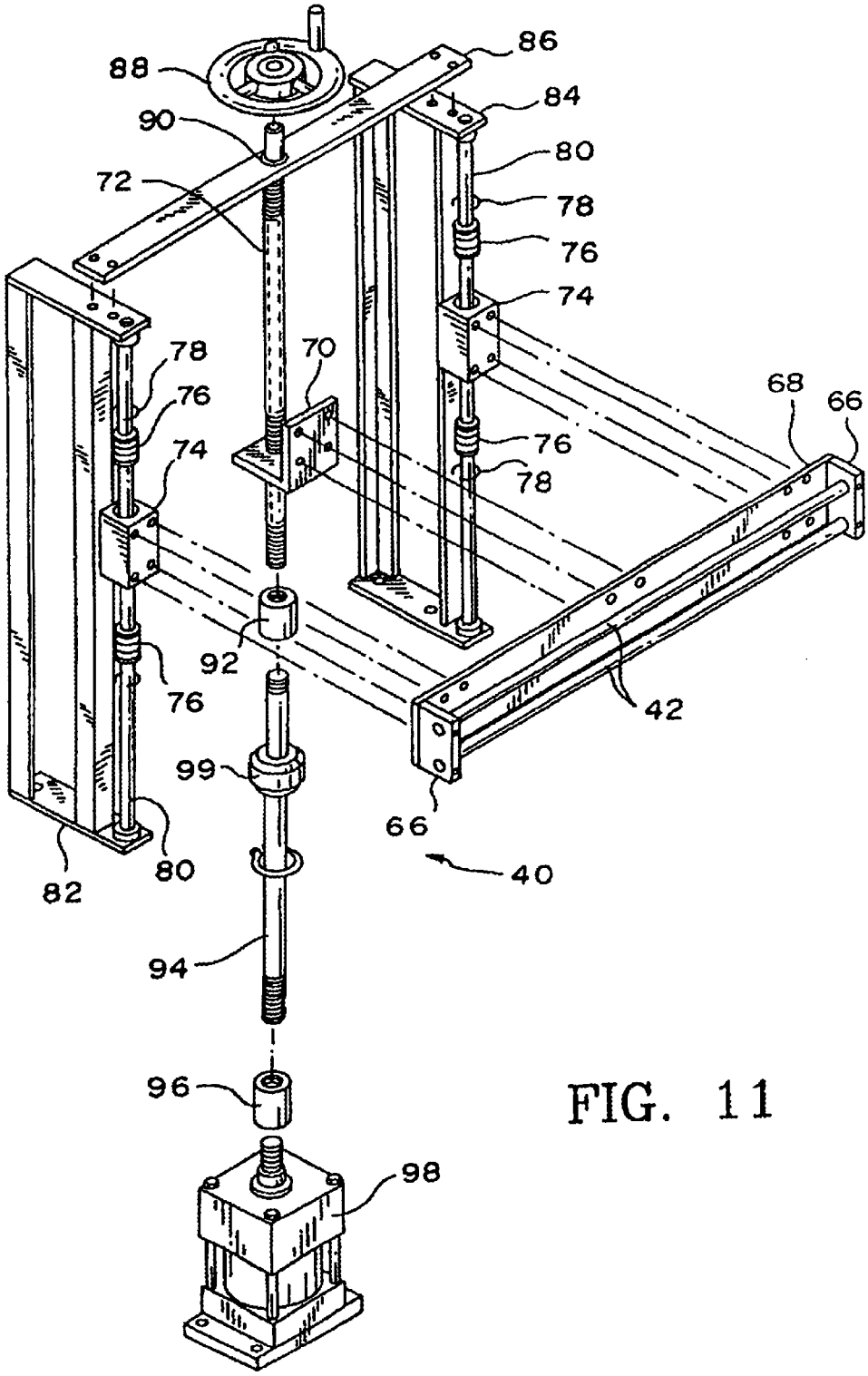
FIG. 11 is an exploded view of a reciprocating carrier according to the invention.

FIG. 11 shows an exploded view of one embodiment ofthe reciprocating carrier 40 of the invention. The slide rods 42 are connected at their ends to slide rod supports 66 which are attached to a support plate 68. The support plate 68 is attached to a lift bracket 70 and two bearing blocks 74. The lift bracket 70 is threadably engaged on an adjusting screw 72. The support plate 68 is attached to bearing blocks 74 which bear on pairs of linear bearings 76 retained in place by internal retaining rings 78. The bearing blocks 74 ride on the slide shafts 80. The slide shafts 80 are supported by left side and right side lift supports 82, 84 respectively. The adjusting screw 72 is inserted through a bushing 90 and a support plate 86 which is attached to the left and right side lift supports 82, 84. A hand wheel 88 is attached to one end of the adjusting screw 72 to adjust the vertical position of the lift bracket 70 and, consequently, the vertical position of the slide rods 42. By adjusting the vertical position of the slide rods 42, the vertical position of the nozzles 36 with respect to the cartridge may be adjusted.

The shaft coupling 92 connects the adjusting screw 72 to a connecting rod 94. The connecting rod 94 is supported by a bushing 99. The connecting rod 94 is connected via an air cylinder coupling 96 to an air cylinder 98. The air cylinder 98 provides the vertical reciprocating motion to the lift bracket 70.

Figure 12:
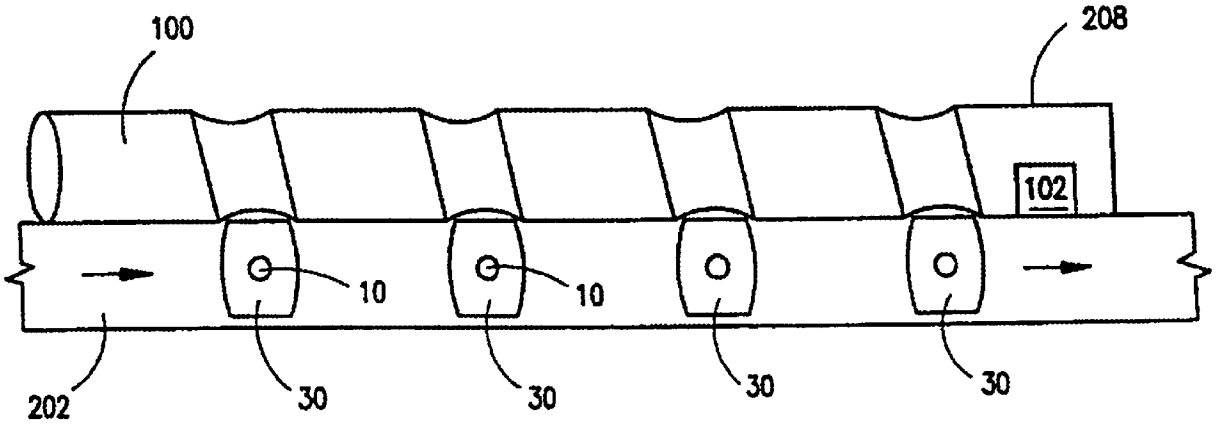
FIG. 12 schematically shows an apparatus for sealing cartridges according to the invention.

FIG. 12 schematically shows the sealing arrangement of the present invention. Pucks 30 with cartridges 10 inserted therein move along the conveyor 202 of the assembly line 200 to a rotary screw 100. The rotary screw 100 engages the individual pucks 30 and moves them in a predetermined spacing relative to each other. The sealer 208 applies the seal 18 to the top of the cartridge via the heating head 102. Because the multiple compartment cartridge 10 includes surfaces other than the circumference that must be sealed, that is, the top surfaces of the ribs 26 and the through holes 20, 22, a novel heating head 102 is used.

Figure 13:
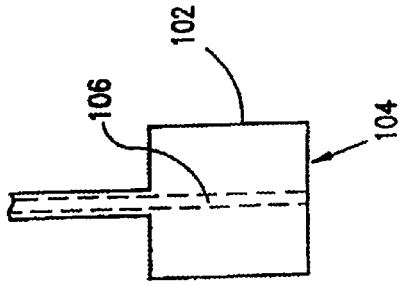
FIG. 13 shows a flat heating head according to the invention.

As shown in FIG. 13, the heating head 102 has a flat head surface 104. The flat head surface 104 is necessary so that all the surfaces of the cartridge may be sealed simultaneously. Prior heating heads used a concave surface which was acceptable because there were no sealing surfaces located inside the circumference of the container. However, such a convex heating head would be difficult to use with multiple compartment cartridges. That is, if the convex heating head were applied to a multiple compartment cartridge, the surfaces internal to the circumference of the cartridge would have to be melted somewhat before the heating head would contact the circumference of the cartridge. This would result in unacceptable dimensional changes to the cartridge. The heating head 102 also includes a vacuum line 106 for holding the seal 18 on the head prior to applying the seal to the cartridge.

While the invention has been described with reference to certain preferred embodiments, numerous changes, alterations and modifications to the described embodiments are possible without departing from the spirit and scope of the invention, as defined in the appended claims and equivalents thereof.

What is claimed is:

1. An apparatus for filling a substantially cylindrical-shaped cartridge having an eccentric hole therein and at least two compartments for storing fluid, comprising:

at least one reservoir of fluid;

at least two metering pumps connected to the at least one reservoir of fluid;

at least two filling tubes connected to the at least two metering pumps, respectively; wherein each filling tube simultaneously fills one of the at least two compartments in the cartridge with the fluid; and a puck which defines a substantially cylindrical cavity and a pin eccentrically disposed in the substantially cylindrical cavity whereby the cartridge may be inserted in the cavity in the puck and aligned by insertion of the pin of the puck in the eccentric hole of the cartridge.

2. The apparatus of claim 1 wherein the cartridge has at least three compartments for storing fluid, the apparatus further comprising at least three metering pumps connected to the at least one reservoir of fluid, and at least three filling tubes connected to the at least three metering pumps, respectively; wherein each filling tube simultaneously fills one of the at least three compartments in the cartridge with the fluid.

3. The apparatus of claim 1 wherein the cartridge has at least four compartments for storing fluid, the apparatus further comprising at least four metering pumps connected to the at least one reservoir of fluid, and at least four filling tubes connected to the at least four metering pumps, respectively; wherein each filling tube simultaneously fills one of the at least four compartments in the cartridge with the fluid.

4. The apparatus of claim 1 further comprising a plate; at least two nozzles connected to the at least two filling tubes, respectively; the at least two nozzles being mounted in the plate; and means for reciprocating the plate such that the at least two nozzles can be inserted into and removed from the at least two compartments of the cartridge.

5. The apparatus of claim 1 further comprising a plate; at least two nozzles connected to the at least two filling tubes, respectively; the at least two nozzles being mounted in the plate; and a reciprocating carrier connected to the plate such that the at least two nozzles can be inserted into and removed from the at least two compartments of the cartridge.

6. An apparatus according to claim 1, including a cartridge having at least two compartments for storing fluid.

7. An apparatus for filling a substantially cylindrical-shaped cartridge having an eccentric hole therein and first and second compartments for storing fluid, comprising:

first and second reservoirs containing first and second fluids, respectively;

first and second metering pumps connected to the first and second reservoirs, respectively;

first and second filling tubes connected to the first and second metering pumps, respectively; wherein the first and second filling tubes simultaneously fill the first and second compartments in the cartridge with the first and second fluids, respectively a puck which defines a substantially cylindrical cavity and a pin eccentrically disposed in the substantially cylindrical cavity whereby the cartridge may be inserted in the cavity in the puck and aligned by insertion of the pin of the puck in the eccentric hole of the cartridge.

8. An apparatus according to claim 7, including a cartridge having at least two compartments for storing fluid.

9. An apparatus for filling a substantially cylindrical-shaped cartridge having an eccentric hole therein and first, second and third compartments for storing fluid, comprising:

first, second and third reservoirs containing first, second and third fluids, respectively;

first, second and third metering pumps connected to the first, second and third reservoirs, respectively;

first, second and third filling tubes connected to the first, second and third metering pumps, respectively;

wherein the first, second and third filling tubes simultaneously fill the first, second and third compartments in the; cartridge with the first, second, and third fluids, respectively an a puck which defines a substantially cylindrical cavity and a pin eccentrically disposed in the substantially cylindrical cavity whereby the cartridge may be inserted in the cavity in the puck and aligned be insertion of the pin of the puck in the eccentric hole of the cartridge.

10. An apparatus according to claim 9, including a cartridge having at least two compartments for storing fluid.

11. An apparatus for filling a substantially cylindrical-shaped cartridge an eccentric hole therein and having first, second, third and fourth compartments for storing fluid, comprising:

first, second, third and fourth reservoirs containing first, second, third and fourth fluids, respectively;

first, second, third and fourth metering pumps connected to the first, second, third and fourth reservoirs, respectively;

first, second, third and fourth filling tubes connected to the first, second, third and fourth metering pumps, respectively;

wherein the first, second, third and fourth filling tubes simultaneously fill the first, second, third and fourth compartments in the cartridge with the first, second, third and fourth fluids, respectively land a puck which defines a substantially cylindrical cavity and a pin eccentrically disposed in the substantially cylindrical cart whereby the cartridge may be inserted in the cart in the puck and aligned by insertion of the pin of the puck in the eccentric hole of the cartridge.

12. An apparatus according to claim 11, including a cartridge having at least two compartments for storing fluid.

13. The apparatus of claim 11 further comprising a plate; first, second, third and fourth nozzles connected to the first, second, third and fourth filling tubes, respectively; the first, second, third and fourth nozzles being mounted in the plate; and means for reciprocating the plate such that the first, second, third and fourth nozzles can be inserted into and removed from the first, second, third and fourth compartments of the cartridge.

14. The apparatus of claim 11 further comprising a plate; first, second, third and fourth nozzles connected to the first, second, third and fourth filling tubes, respectively; the first, second, third and fourth nozzles being mounted in the plate; and a reciprocating carrier connected to the plate such that the first, second, third and fourth nozzles can be inserted into and removed from the first, second, third and fourth compartments of the cartridge.

15. A method of filling a cartridge having at least two compartments for storing fluid, comprising:

placing the cartridge under at least two nozzles;

inserting the at least two nozzles into the at least two compartments of the cartridge such that only one nozzle enters each compartment;

filling the at least two compartments with fluid; and removing the at least two nozzles from the at least two compartments; and before the placing step, the step, of loading the cartridge in a puck and aligning the cartridge by inserting a pin of the puck in an eccentric hole of the cartridge.

16. A method of filling a cartridge having first, second, third and fourth compartments for storing fluid, comprising:

placing the cartriage under at least four nozzles;

inserting the at least four nozzles into the first, second, third and fourth compartments of the cartridge such that only one nozzle enters each compartment;

filling the first, second, third and fourth compartments with first, second, third and fourth fluids, respectively; and removing the nozzles from the first, second, third and fourth compartments; and before the placing step, the step of loading the cartridge in a puck and aligning the cartridge by inserting a pin of the puck in an eccentric hole of the cartridge.

17. The method of claim 16 wherein the first, second, third and fourth fluids are a same fluid.

18. The method of claim 16 wherein the first and second fluids are a same fluid and the third and fourth fluids are a same fluid different from the first and second fluids.

19. The method of claim 16 wherein the first, second and third fluids are a same fluid and the fourth fluid is a different fluid.

20. An apparatus for filling a container having at least two compartments for storing a fluid, comprising:

at least one reservoir for containing fluid;

at least one metering pump connected to said at least one reservoir;

at least two filling tubes connected to said at least one metering pump for at least partially filling said container; and a holder aligned and fixed from rotation relative to said two filling tubes, said holder configured for aligning said container relative to said two filling tubes, said holder is configured to be translated relative to said two filling tubes and moved on a conveyor, said holder is a puck provided with at least one surface for aligning said puck relative to said conveyor, said puck is provided with a pair of parallel alignment surfaces for contacting with a pair of alignment rails provided on either side of said conveyor, said puck is configured for aligning the container relative to said puck, and at least one surface on said puck is configured to engage with a surface on the container for aligning the container within said puck.

21. An apparatus according to claim 20, wherein said alignment pin is eccentrically disposed relative to a center position of the container, and the container is provided with an eccentrically disposed hole for engaging with said alignment pin for aligning the container within said puck.

22. An apparatus according to claim 20, including another separate metering pump connected to said at least one reservoirs and one of said at least two filling tubes to allow independent control and metering of fluid into the at least two compartments of the container.

23. An apparatus according to claims 20, including another separate reservoir for containing a fluid, said apparatus configured for providing fluid from both reservoirs to the container.

24. An apparatus according to claim 23, wherein said reservoirs are independently connected to said metering pumps and said filling tubes, respectively, for providing fluid from each reservoir to a different compartment of the container.

25. An apparatus according to claim 20, wherein said apparatus is configured for simultaneously filling said compartments.

26. An apparatus according to claim 20, wherein the container is a cartridge.

27. An apparatus according to claim 20, including at least one container having at least two compartments.

* * * * *